US010071827B2

(12) United States Patent
Cerf

(10) Patent No.: US 10,071,827 B2
(45) Date of Patent: Sep. 11, 2018

(54) RESTRAINING FLAPS OF AN INSERT

(71) Applicant: Alain Cerf, N. Redington Beach, FL (US)

(72) Inventor: Alain Cerf, N. Redington Beach, FL (US)

( * ) Notice: Subject to any disclaimer, the term of this patent is extended or adjusted under 35 U.S.C. 154(b) by 888 days.

(21) Appl. No.: 13/708,841

(22) Filed: Jan. 15, 2013

(65) Prior Publication Data

US 2014/0196409 A1 Jul. 17, 2014

(51) Int. Cl.

| | |
|---|---|
| ***B65B 11/58*** | (2006.01) |
| ***B65B 9/02*** | (2006.01) |
| ***B65B 35/24*** | (2006.01) |
| ***B65B 11/10*** | (2006.01) |
| ***B65B 53/02*** | (2006.01) |
| ***B65B 61/22*** | (2006.01) |

(52) U.S. Cl.

CPC ..... *B65B 11/58* (2013.01); *B65B 9/026* (2013.01); *B65B 11/10* (2013.01); *B65B 35/243* (2013.01); *B65B 53/02* (2013.01); *B65B 61/22* (2013.01)

(58) Field of Classification Search

CPC ..... B65B 9/026; B65B 11/06; B65B 11/08; B65B 11/10; B65B 11/58; B65B 35/243; B65B 35/40; B65B 35/405; B65B 53/02; B65B 2220/16; B65D 71/10; B65D 71/38

USPC ..... 53/461, 203, 466, 209, 210, 218, 387.1, 53/387.2, 376.3, 376.4, 376.7, 228, 442, 53/557, 456, 564, 462, 48.1, 48.2, 48.6, 53/48.7

See application file for complete search history.

(56) References Cited

U.S. PATENT DOCUMENTS

| | | | | | |
|---|---|---|---|---|---|
| 2,308,010 | A * | 1/1943 | Horowitz | 53/377.2 | |
| 2,424,406 | A * | 7/1947 | Marshall et al. | 53/449 | |
| 3,138,905 | A * | 6/1964 | Ellinger | B65B 7/2871 | 493/102 |
| 3,295,290 | A * | 1/1967 | Billingsley et al. | 53/398 | |
| 3,340,996 | A * | 9/1967 | Cerf | B65B 25/04 | 198/803.11 |
| 3,499,263 | A * | 3/1970 | Byrd et al. | 53/210 | |
| 3,600,875 | A * | 8/1971 | Buob et al. | 53/442 | |
| 3,665,675 | A * | 5/1972 | Johnson | 53/223 | |
| 3,714,757 | A * | 2/1973 | Feigel et al. | 53/75 | |
| 3,869,844 | A * | 3/1975 | Edouard | B65B 53/02 | 219/388 |
| 3,878,943 | A * | 4/1975 | Ryan et al. | 206/497 | |
| 4,010,597 | A * | 3/1977 | Nelson | 53/376.5 | |
| 4,060,959 | A * | 12/1977 | Fiedler et al. | B65B 9/02 | 53/209 |

(Continued)

FOREIGN PATENT DOCUMENTS

| | | | | |
|---|---|---|---|---|
| DE | 3409422 A1 * | 9/1985 | ..... | B65B 11/58 |
| DE | 102006054469 B3 * | 12/2007 | ..... | B65B 11/10 |

(Continued)

*Primary Examiner* — Stephen F Gerrity
(74) *Attorney, Agent, or Firm* — Sam Silverberg

(57) ABSTRACT

The invention is directed to solving the problem of wrapping a bundle with cardboard without using glue to hold the cardboard flaps in place before wrapping the bundle with a heat shrink film. The problem is solved by using a mechanical fly bars to restrain the flaps of an insert while moving a bundle on a conveyor. The insert can be any material that provides structural protection to the bundle during stacking.

20 Claims, 3 Drawing Sheets

(56) References Cited

U.S. PATENT DOCUMENTS

| | | | | | |
|---|---|---|---|---|---|
| 4,069,643 | A * | 1/1978 | Young et al. | B65B 9/026 53/434 |
| 4,173,921 | A * | 11/1979 | Mack | 493/142 |
| 4,319,443 | A * | 3/1982 | Watts, Jr. | 53/466 |
| 4,574,565 | A * | 3/1986 | Gambetti | 53/442 |
| 4,662,148 | A * | 5/1987 | Nilsson | 53/399 |
| 5,148,654 | A * | 9/1992 | Kisters | 53/462 |
| 5,379,575 | A * | 1/1995 | Focke et al. | 53/543 |
| 5,735,378 | A * | 4/1998 | Sundquist | 193/35 C |
| 6,474,041 | B1 * | 11/2002 | Gambetti | 53/141 |
| 6,658,819 | B2 * | 12/2003 | Gamberini | 53/436 |
| 2003/0101695 | A1 * | 6/2003 | Chiu | 53/493 |
| 2004/0083690 | A1 * | 5/2004 | Gambetti | 53/498 |
| 2005/0091944 | A1 * | 5/2005 | Goodman | 53/491 |
| 2005/0133341 | A1 * | 6/2005 | Chiu | 198/419.1 |
| 2012/0291399 | A1 * | 11/2012 | Bonneville et al. | B65B 9/04 53/203 |

FOREIGN PATENT DOCUMENTS

| | | | | |
|---|---|---|---|---|
| DE | 102010044747 | A1 * | 3/2012 | B65B 11/10 |
| FR | 2576282 | A1 * | 7/1986 | B65B 53/06 |
| FR | 2582617 | A1 * | 12/1986 | B65B 9/02 |
| GB | 1162258 | A * | 8/1969 | B65D 71/10 |
| JP | 52032780 | A * | 3/1977 | |

* cited by examiner 2-3

RESTRAINING FLAPS OF AN INSERT

FIELD OF THE INVENTION

This invention relates to wrapping a cardboard around an article or a bundle of articles to provide structural support to the article or bundle to prevent crushing of the article.

BACKGROUND OF THE INVENTION

Packaging bundles on a pallets required placing the bundles in a box to prevent the bundles from being crushed during stacking. Using cardboard box increased the cost of the manufacturing. This created a need to provide a bundle to that was more resistant to crushing that be packaged on a pallet without the need for a cardboard box.

The use of cardboard inserts to provide structural integrity to a bundle was described in U.S. patent application Ser. No. 13/453,931 filed on Apr. 23, 2012. The inventor was Alain Cerf. This application is incorporated by reference in its entirety. U.S. Pat. No. 5,934,049 filed on Aug. 10, 1999 is incorporated by reference in its entirety.

SUMMARY OF THE INVENTION

One of the objectives of the invention is to resolve the problem of wrapping a bundle with cardboard without using glue to hold the cardboard flaps in place before wrapping the bundle with a heat shrink film. A bundle is defined a single article or a collection of articles. By eliminating the gluing of the cardboard, a heat shrink machine can operate at a faster speed. Another objective of the invention is to use two U shaped cardboard as described in the above application. This alleviates the problem associated with using a single large piece of cardboard to provide stacking support for a large bundle. Another objective is to use an insert where the bundle is placed on the insert and the flaps of the insert are pressed against the bundle. The objectives of this invention are achieved by restraining the flaps surrounding the bundle while traveling on a conveyor prior to film wrapping the bundle and heat shrinking the film.

DETAILED DESCRIPTION OF THE INVENTION

Figure 1:
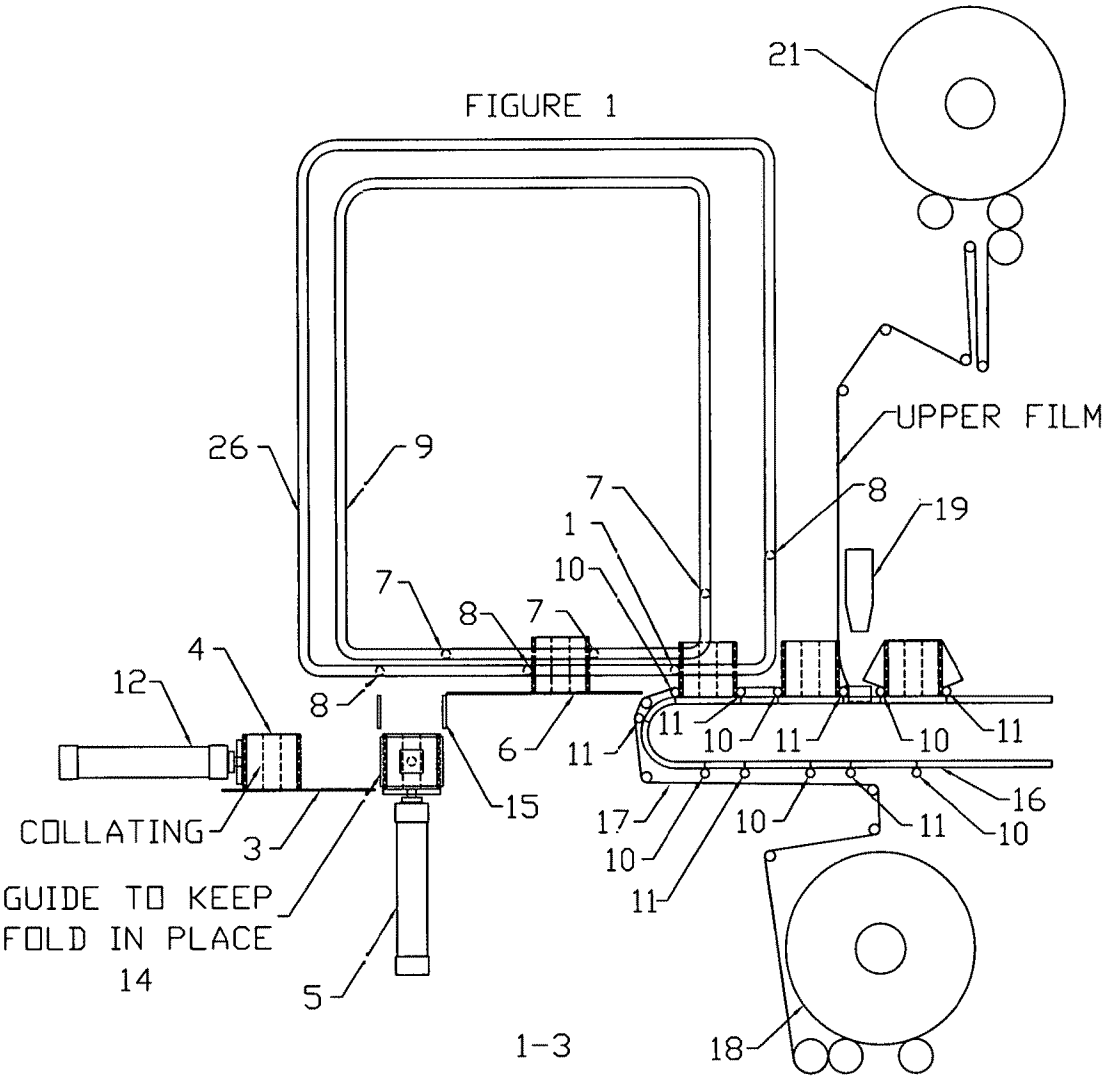
FIG. 1 shows a bundle wherein the flaps of the bundle are restrained from moving by flying bars.
Figure 2:
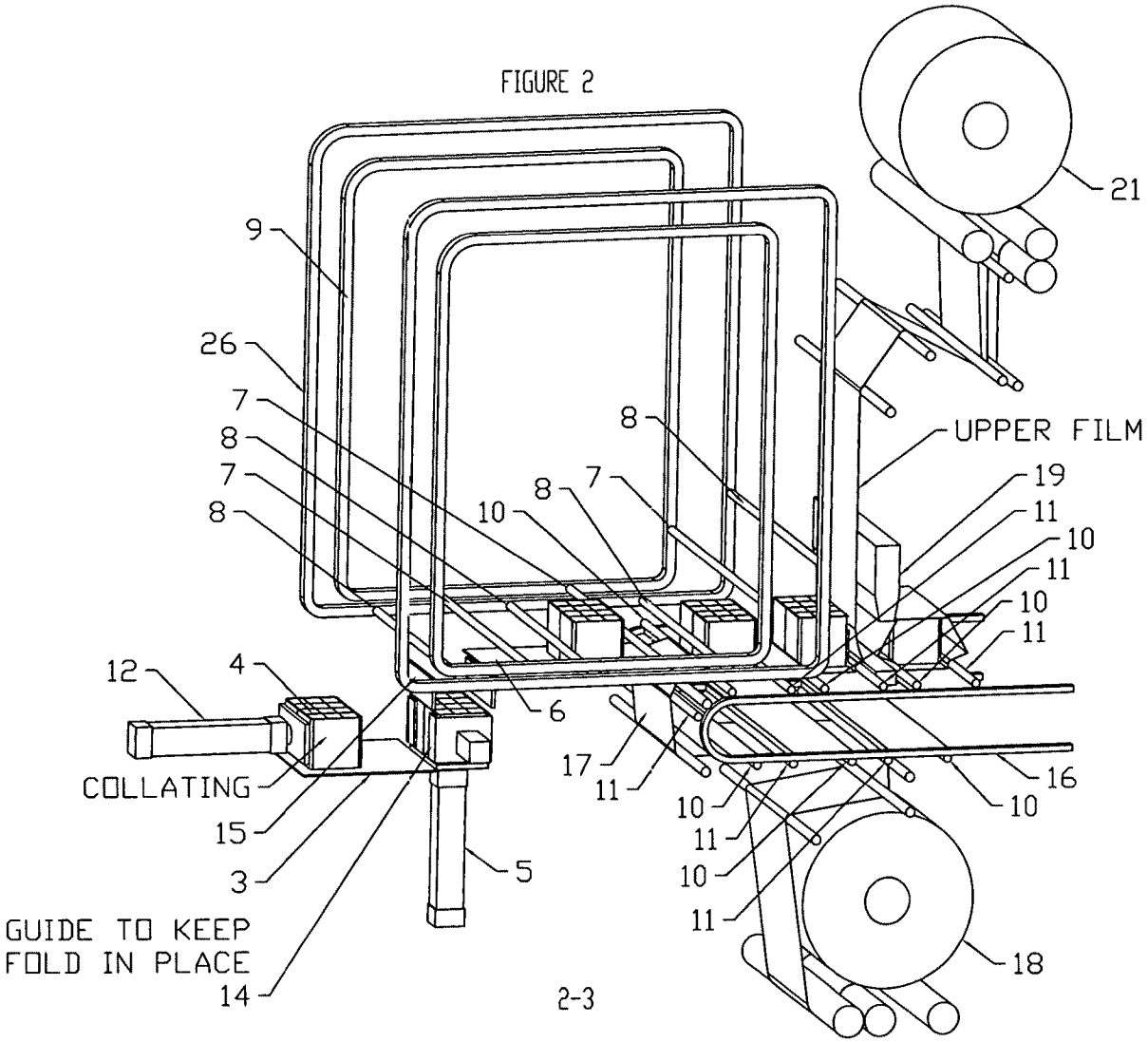
FIG. 2 shows a bundle being placed in a bucket conveyor so that the bundle rests on the film.

An article or a bundle of articles 4 having a u shaped cardboard at each or end of the article or a cardboard insert that provides structural support to a bundle is placed on a dead plate 6 located substantially parallel to bucket conveyor 16. The plate is slightly above elements 10 and 11 and extends as close as possible to element 11 to facilitate the placement of the bundle in the buckets defined by elements 10 and 11.

A pusher 12 moves a collated bundle 4, having guides 14 to hold the flaps in place, on a plate 3 to an elevator 5. When the flying conveyors are substantially stopped or stopped, the elevator 5 lifts the collated bundle 4 through vertical transfer guides to substantially the same level as the dead plate 6 so that the bundle is between flying bars 7 and 8. The vertical transfer guides 15 maintain the flaps in a restrained position.

Flying bar 7 travels on flying bar conveyor 9. Flying bar 8 travels on flying bar conveyor 26. The position of the flying bars can be adjusted to accommodate the size of the bundle. After the bundle is placed between the flying bars 7 and 8, the flying conveyors begin to move causing flying bar 8 to push against the bundle. Fly bar 8 moves the bundle on the dead plate toward bucket package conveyor 16 while the fly bars 7 and 8 prevent the flaps from opening away from the bundle. The movement of fly bar conveyors is synchronized with the movement with the bucket conveyor 16. The bucket conveyor is moving at the same speed as the flying bar conveyors. The bundle is pushed off the dead plate by fly bar 8. Fly bar conveyors are arranged so that fly bars 7 and 8 guide the bundle off the dead plate into the bucket. When the flying bars 7 and 8 releases the bundle as the flying bars move up, the bucket conveyor stops and a bucket is positioned underneath the bundle to receive the bundle. Elements 10 and 11 which can be the sides of the bucket restrain the flaps of the bundle when the bundle rests in the bucket. Once the fly bars clear the height of the bundle, the flying bar conveyors stop and a new bundle on elevator 5 is inserted between fly bars 7 and 8. After the bundle is inserted between fly bars 7 and 8, the fly bar conveyors and bucket conveyor restart the cycle. If there is no product available to be placed in the bucket, only the bucket conveyor will move.

The heat shrink film 17 comes off roll 18 and is threaded so that film covers the bucket so that when the bundle is placed on the bucket, the bundle rests on the film. The film continues in a substantial vertical direction onto roll 21 so that the bundle can push against the plane of the film causing the film to wrap around the bundle. As the bundle passes the sealing bar 19, the sealing bar comes down and heat seals and cuts the film thereby presenting the next bundle a continuous plane of film for wrapping.

Figure 3:
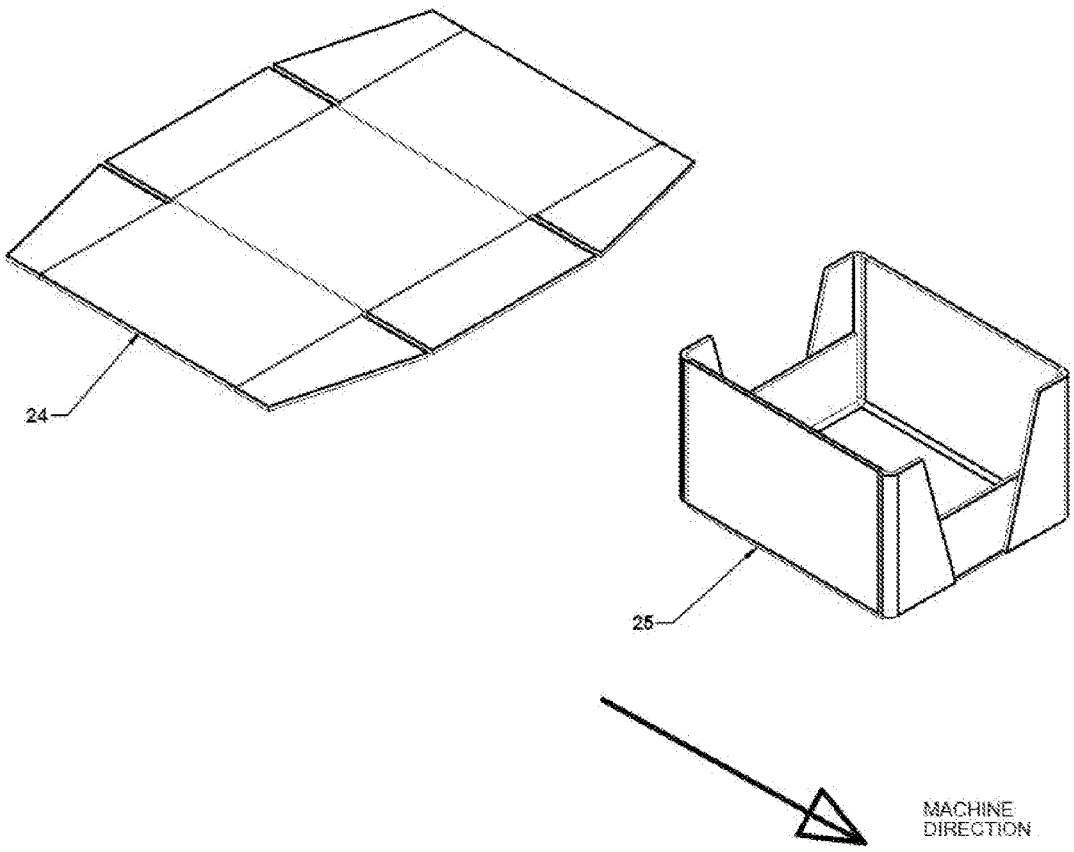
FIG. 3 shows an insert for a bundle.

FIG. 3 shows insert 24 having flaps 25.

The invention claimed is:

1. An apparatus for transporting a bundle having an insert with flaps on the outside of the bundle to provide structural integrity to the bundle while mechanically restraining the flaps of the insert while moving the bundle on a conveyor comprising, means for moving the bundle wherein the flaps of an insert are mechanically restrained, means for transporting the bundle onto a film wrapping conveyor while restraining the movement of the flaps, means for film wrapping the bundle with a heat shrinkable film while on said film wrapping conveyor, and means for heat shrinking the film.

2. An apparatus according to claim 1 wherein the means for moving the bundle includes pushing the bundle on a dead plate.

3. An apparatus according to claim 2 wherein the bundle is pushed by a first fly bar attached to a first fly bar conveyor.

4. An apparatus according to claim 3 wherein a second fly bar attached to a second fly bar conveyor acts together with the first fly bar to restrain the movement of the flaps while the bundle is being moved.

5. An apparatus according to claim 4 wherein the film wrapping conveyor has buckets to receive the bundle and to restrain the movements of the flaps.

6. An apparatus according to claim 5 wherein the means for film wrapping includes a film threaded over the bucket and for providing a plane of film so that the bundle resting on the film pushes into the plane causing the film to cover the bundle.

7. An apparatus according to claim 6 wherein a sealing bar heat seals the film around the bundle and cuts the film to maintain the plane of the film so that the next bundle can be wrapped.

8. An apparatus according to claim 7 including means for stopping the bucket conveyor when the first and second fly bars release the bundle and the bucket is positioned under the bundle.

9. An apparatus according to claim 8 including means for stopping the fly bar conveyors after the first and second fly bars clear the height of the bundle.

10. An apparatus according to claim 9 including means for moving a bundle between another pair of fly bars while the fly bar conveyors are stopped.

11. A process for transporting a bundle having an insert with flaps on the outside of the bundle while mechanically restraining the flaps of the insert while moving the bundle on a conveyor comprising, moving the bundle with a means for moving the bundle wherein the flaps of an insert are mechanically restrained, transporting the bundle with a means for transporting the bundle onto a film wrapping conveyor while restraining the movement of the flaps, film wrapping the bundle with a means for film wrapping the bundle with a heat shrinkable film while on said film wrapping conveyor, and heat shrinking the film wrapped bundle.

12. A process according to claim 11 wherein moving the bundle includes pushing the bundle on a dead plate.

13. A process of according to claim 12 wherein a first fly bar attached to a first fly bar conveyor pushes the bundle.

14. A process according to claim 13 includes restraining the flaps of the moving bundle by using a second fly bar attached to a second fly bar conveyor.

15. A process according to claim 14, including providing a film wrapping conveyor having buckets to receive the bundle and to restrain the movements of the flaps.

16. A process according to claim 15 including threading the heat shrink film over the bucket so that the bundle can be placed in bucket and rest on the film.

17. A process according to 16 including providing a plane of film and pushing the bundle into the plane causing the film to cover the bundle.

18. A process according to claim 17 including stopping the bucket conveyor when a bucket is positioned to receive a bundle being released by the first and second fly bars.

19. A process according to claim 18 including stopping the fly bar conveyors after the first and second fly bars clear the height of the bundle.

20. A process according to claim 19 including moving a bundle between another pair of fly bars when the fly bar conveyors are stopped.

* * * * *